US011821437B2

(12) United States Patent
Oka et al.

(10) Patent No.: US 11,821,437 B2
(45) Date of Patent: Nov. 21, 2023

(54) COMPRESSOR, COMPRESSOR ASSEMBLY, AND METHOD OF ASSEMBLING COMPRESSOR

(71) Applicant: MITSUBISHI HEAVY INDUSTRIES COMPRESSOR CORPORATION, Tokyo (JP)

(72) Inventors: Hiroaki Oka, Hiroshima (JP); Jun Koyanagi, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 17/585,113

(22) Filed: Jan. 26, 2022

(65) Prior Publication Data

US 2022/0243738 A1 Aug. 4, 2022

(30) Foreign Application Priority Data

Feb. 3, 2021 (JP) ..... 2021-015854

(51) Int. Cl.
*F04D 29/42* (2006.01)
*F04D 17/10* (2006.01)

(52) U.S. Cl.
CPC ..... *F04D 29/4206* (2013.01); *F04D 17/10* (2013.01)

(58) Field of Classification Search
CPC ..... F04D 17/10; F04D 17/12; F04D 29/4206; F04D 29/601–603; F04D 29/624; F05D 2230/60–70; F05D 2240/14
See application file for complete search history.

(56) References Cited

U.S. PATENT DOCUMENTS

| | | | | |
|---|---|---|---|---|
| 5,971,702 | A * | 10/1999 | Afton | F01D 25/285 29/888.011 |
| 8,974,176 | B2 * | 3/2015 | Sasaki | F04D 17/122 415/199.5 |
| 9,638,196 | B2 * | 5/2017 | Yoshida | F04D 29/4206 |
| 9,822,798 | B2 * | 11/2017 | Yoshida | F04D 17/125 |
| 10,001,143 | B2 * | 6/2018 | Yoshida | F04D 29/284 |
| 10,233,945 | B2 * | 3/2019 | Yoshida | F04D 29/403 |
| 10,267,336 | B2 * | 4/2019 | Masuda | F04D 17/125 |
| 2012/0243982 | A1 | 9/2012 | Sasaki et al. | |
| 2017/0350418 | A1 | 12/2017 | Masuda et al. | |

FOREIGN PATENT DOCUMENTS

| | | | |
|---|---|---|---|
| DE | 102016217669 | A1 * | 3/2018 |
| JP | 6521392 | B2 | 5/2019 |
| WO | 2014-102126 | A1 | 7/2014 |

* cited by examiner

*Primary Examiner* — Brian P Wolcott
(74) *Attorney, Agent, or Firm* — Osha Bergman Watanabe & Burton LLP

(57) ABSTRACT

A compressor includes: a casing that is formed in a cylindrical shape and has an opening portion that makes an inside and an outside of the casing communicate with each other at a lower portion in a vertical direction; a bundle that is accommodated inside the casing in a state of being insertable and removable in the axial direction; a first roller that is disposed at an end portion of a lower portion of the bundle and comes into contact with an inner peripheral surface of a lower portion of the casing; and a second roller that is disposed at the lower portion of the bundle at an interval from the first roller, and comes into contact with the inner peripheral surface of the lower portion of the casing.

5 Claims, 14 Drawing Sheets

COMPRESSOR, COMPRESSOR ASSEMBLY, AND METHOD OF ASSEMBLING COMPRESSOR

BACKGROUND OF THE INVENTION

Field of the Invention

The present disclosure relates to a compressor, a compressor assembly, and a method of assembling a compressor.

Priority is claimed on Japanese Patent Application No. 2021-015854, filed on Feb. 3, 2021, the content of which is incorporated herein by reference.

Description of Related Art

In Japanese Patent No. 6521392, there is disclosed a configuration in which when inserting a bundle into a casing of a compressor, a side roller provided at a leading end portion of the bundle, an end portion support portion that supports a rear end portion of the bundle, and a pair of intermediate support portions that support an intermediate portion of the bundle are provided. In such a configuration, the bundle is inserted into the casing by moving the side roller, the end portion support portion, and the intermediate support portions along a rail disposed outside the casing and the inner peripheral surface of the casing.

SUMMARY OF THE INVENTION

Incidentally, there is a case where an opening that communicates with an introduction nozzle for introducing a working fluid into a casing or a discharge nozzle for discharging the working fluid in the casing is formed in a lower portion of the casing. In the configuration disclosed in Japanese Patent No. 6521392, when an attempt is made to insert the bundle into the casing having such an opening portion, there is a case where the side roller or the intermediate support portion interferes with the opening, making it difficult to insert the bundle.

The present disclosure provides a compressor, a compressor assembly, and a method of assembling a compressor, in which even in a casing having an opening portion at a lower portion, it is possible to easily and reliably perform the insertion of a bundle.

According to an aspect of the present disclosure, there is provided a compressor including: a casing that is formed in a cylindrical shape centered on an axis and has an opening portion that makes an inside and an outside of the casing communicate with each other at a lower portion in a vertical direction; a bundle that is formed in a columnar shape extending in an axial direction in which the axis extends, and accommodated inside the casing in a radial direction with respect to the axis in a state of being insertable and removable in the axial direction with respect to the casing; a first roller that is disposed at an end portion of a lower portion of the bundle in the vertical direction and comes into contact with an inner peripheral surface of a lower portion of the casing in a state where the bundle is inserted into the casing; and a second roller that is disposed at the lower portion of the bundle in the vertical direction at an interval from the first roller in the axial direction, and comes into contact with the inner peripheral surface of the lower portion of the casing in a state where the bundle is inserted into the casing.

According to another aspect of the present disclosure, there is provided a compressor assembly including: the compressor as described above; and a sensor that is disposed at an end portion on a second side of the casing in the axial direction and measures the interval between an outer peripheral surface of the bundle and an inner peripheral surface of the casing in the radial direction.

According to still another aspect of the present disclosure, there is provided a method of assembling the compressor as described above, including: bringing one of the first roller and the second roller into contact with an inner peripheral surface of the casing in a case where the other of the first roller and the second roller is at a position overlapping the opening portion in the axial direction, when the bundle is inserted into the casing.

According to the compressor, the compressor assembly, and the method of assembling a compressor of the present disclosure, even in a casing having an opening portion at a lower portion, it is possible to easily and reliably perform the insertion of the bundle.

DETAILED DESCRIPTION OF THE INVENTION

Hereinafter, a mode for carrying out a compressor, a compressor assembly, and a method of assembling a compressor according to the present disclosure will be described with reference to the accompanying drawings. However, the present disclosure is not limited to this embodiment.

(Configuration of Compressor)

Figure 1:
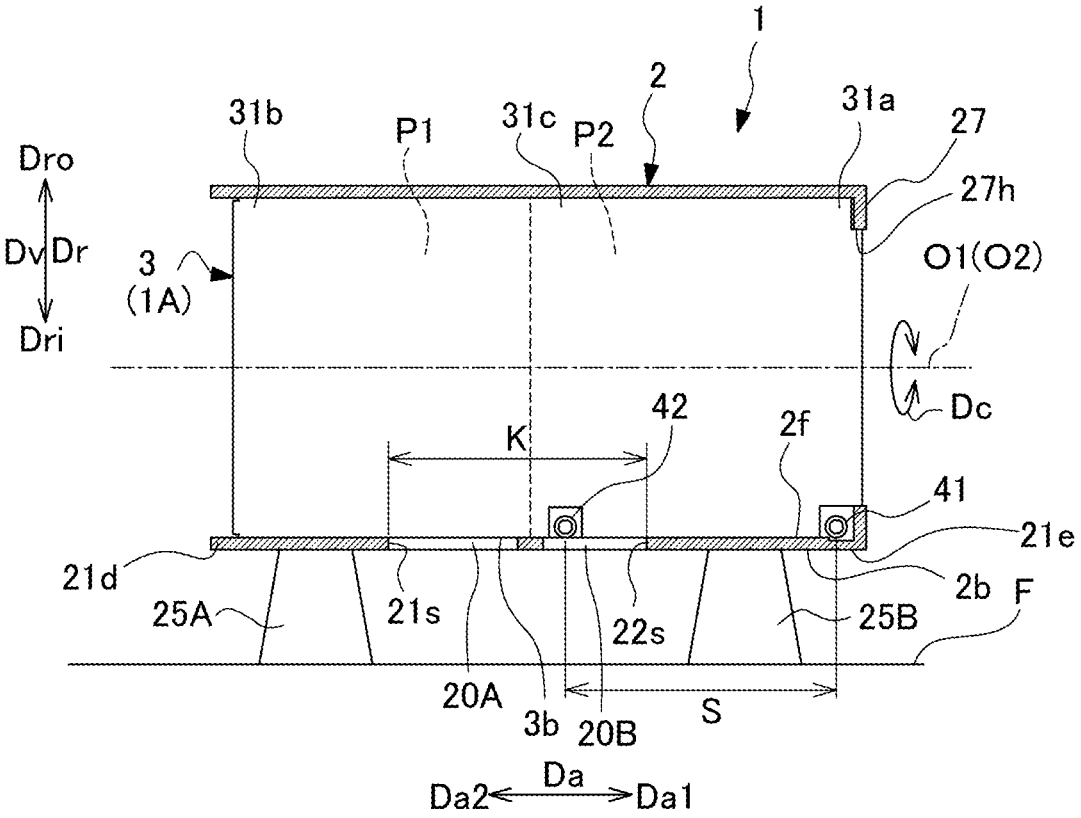
FIG. 1 is a side sectional view showing a schematic configuration of a compressor according to an embodiment of the present disclosure.

As shown in FIG. 1, a compressor 1 mainly includes a casing 2, a bundle 3, a first roller 41, and a second roller 42. The compressor 1 is a uniaxial multi-stage type centrifugal compressor that compresses and discharges a working fluid supplied to the inside. The compressor 1 of the present embodiment has a first compression unit P1 and a second compression unit P2 for compressing the working fluid on a second side Da2 in an axial direction Da and a first side Da1 in the axial direction Da, respectively. The compressor 1 is a so-called back-to-back type in which the first compression unit P1 and the second compression unit P2 are symmetrically provided in the axial direction Da.

In the following, the direction in which an axis O1 of the casing 2 (described later) extends is referred to as the axial direction Da. A radial direction of the casing 2 with respect to the axis O1 is simply referred to as a radial direction Dr. A direction perpendicular to an installation surface F (described later), in the radial directions Dr perpendicular to the axis O1, is referred to as a vertical direction Dv. Further, a direction around a rotor of the compressor 1 centered on the axis O1 is referred to as a circumferential direction Dc.

The casing 2 is formed in a cylindrical shape centered on the axis O1 extending in the axial direction Da. The casing 2 is disposed such that the axial direction Da coincides with the horizontal direction. The casing 2 is disposed so as to cover the bundle 3 from an outside Dro in the radial direction Dr. The casing 2 is supported on the installation surface F by a first support leg 25A and a second support leg 25B disposed at an interval in the axial direction Da. An opening portion that penetrates the casing between the inside and the outside of the casing 2 in the vertical direction Dv is formed in a lower portion 2*b* of the casing 2 in the vertical direction Dv. Here, the lower portion 2*b* of the casing 2 is a portion in the range of 90 degrees to the right and left (preferably the range of 45 degrees to the right and left) centered on the lower end of the casing 2 in the vertical direction Dv when viewed from the axial direction Da. In the present embodiment, a first opening portion 20A and a second opening portion 20B are formed as the opening portion. The first opening portion 20A communicates with a nozzle (not shown) forming an inflow port or an outflow port for the working fluid in the first compression unit P1. The second opening portion 20B communicates with a nozzle (not shown) forming an inflow port or an outflow port for the working fluid in the second compression unit P2. the nozzles of the first compression unit P1 and the second compression unit P2 are fixed to the lower portion 2*b* of the casing 2 by welding or the like, and extend downward in the vertical direction Dv from the outer peripheral surface of the casing 2.

Further, the second side Da2 (one side) in the axial direction Da of the casing 2 is open with a size that allows the bundle 3 to be inserted. An end plate 27 is formed on the first side Da1 (the other side) in the axial direction Da of the casing 2. The end plate 27 has a plate shape extending so as to be orthogonal to the axial direction Da. An insertion hole 27*h* having a size which allows a rotor (not shown) of the compressor 1 to be inserted and does not allow the bundle 3 to be inserted is formed in the central portion of the end plate 27.

The bundle 3 is formed in a columnar shape having a central axis O2 extending in the axial direction Da. The bundle 3 configures a compressor main body 1A of the compressor 1. The bundle 3 has components (not shown) such as a rotor and a diaphragm of the compressor main body 1A. The bundle 3 is accommodated in an inside Dri in the radial direction Dr with respect to the casing 2 so as to be able to be inserted and removed in the axial direction Da.

The first roller 41 and the second roller 42 are fixed to a lower portion 3*b* of the bundle 3 in the vertical direction Dv. Here, the lower portion 3*b* of the bundle 3 is a portion in the range of 90 degrees to the right and left (preferably the range of 45 degrees to the right and left) centered on the lower end of the bundle 3 in the vertical direction Dv when viewed from the axial direction Da. The first roller 41 and the second roller 42 are non-detachably fixed to the bundle 3. That is, the first roller 41 and the second roller 42 are maintained in a state of being fixed to the bundle 3 even during the operation of the compressor 1.

The first roller 41 is disposed at a first end portion 31*a* on the first side Da1 of the bundle 3 in the axial direction Da. The first end portion 31*a* is a leading end when the bundle 3 is inserted into the casing 2. Two first rollers 41 are disposed with respect to the bundle 3 at an interval in the circumferential direction Dc around the central axis O2. The first roller 41 is disposed so as to come into contact with an inner peripheral surface 2*f* of the lower portion 2*b* of the casing 2 in a state where the bundle 3 is inserted into the casing 2.

The second roller 42 is disposed at an interval on the second side Da2 in the axial direction Da with respect to the first roller 41. Two second rollers 42 are disposed with respect to the bundle 3 at an interval in the circumferential direction Dc. The second roller 42 is disposed at an intermediate portion 31*c* where the distance from the first end portion 31*a* on the first side Da1 of the bundle 3 in the axial direction Da and the distance from a second end portion 31*b* on the second side Da2 are substantially the same. The second roller 42 is disposed so as to come into contact with the inner peripheral surface 2*f* of the lower portion 2*b* of the casing 2 in a state where the bundle 3 is inserted into the casing 2. The second roller 42 in the present embodiment is disposed at a position where it comes into contact with the casing 2 as little as possible in a state where the first roller 41 is in contact with the casing 2.

The first roller 41 and the second roller 42 are disposed at a predetermined interval S in the axial direction Da. The interval S between the first roller 41 and the second roller 42 in the axial direction Da is set such that when the bundle 3 is inserted into the casing 2, both the first roller 41 and the second roller 42 do not simultaneously overlap the positions of the first opening portion 20A and the second opening portion 20B in the axial direction Da. Therefore, the interval S between the first roller 41 and the second roller 42 in the axial direction Da is preferably larger than an opening dimension (length) in the axial direction Da of the first opening portion 20A or the second opening portion 20B. In the present embodiment, the interval S between the first roller 41 and the second roller 42 in the axial direction Da is set to be larger than an opening dimension K between a first opening edge 21*s* on the second side Da2 of the first opening portion 20A in the axial direction Da and a second opening edge 22*s* on the first side Da1 of the second opening portion 20B in the axial direction Da.

(Configuration of Compressor Insertion Device)

Figure 2:
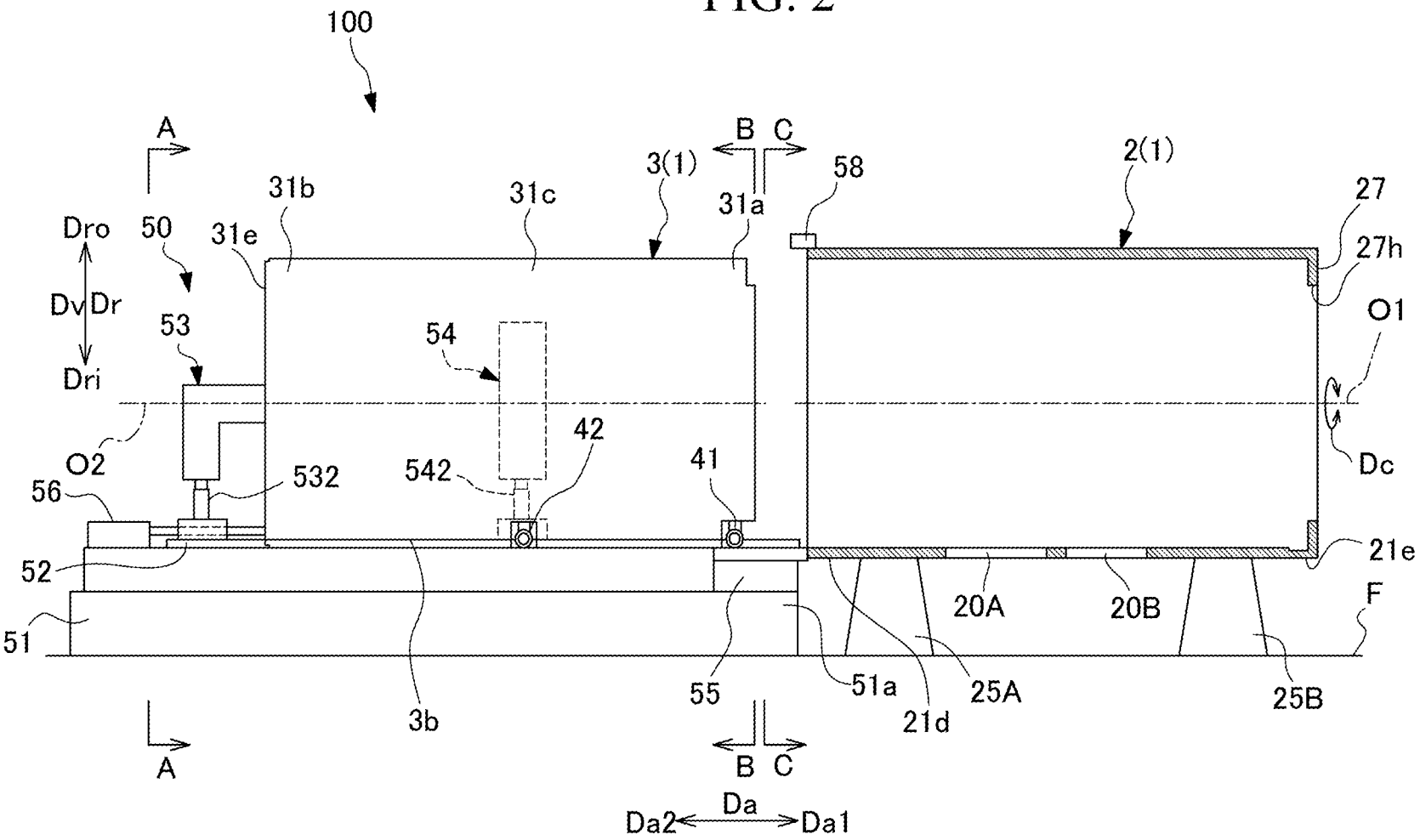
FIG. 2 is a side sectional view showing a state where a bundle is inserted into a casing in the present embodiment.

Next, the configuration of a compressor insertion device of the present embodiment will be described. As shown in FIG. 2, a compressor insertion device 50 is used when inserting or removing the bundle 3 into or from the casing 2. The compressor insertion device 50 includes a bundle stand 51, a first support member 53, a second support member 54, an alignment member 55, a movement mechanism 56, and a sensor 58. In the present embodiment, the compressor 1 and the compressor insertion device 50 are collectively referred to as a compressor assembly 100.

The bundle stand 51 is disposed on the installation surface F on the second side Da2 in the axial direction Da with respect to the casing 2. As shown in FIGS. 2 to 5, a rail 52 is fixed on the bundle stand 51. Two rails 52 are disposed in a pair at an interval in a width direction Dw orthogonal to the axial direction Da and the vertical direction Dv in the horizontal plane. The pair of rails 52 are disposed at an interval larger than the bundle 3 in the width direction Dw. Each of the rails 52 linearly extends in the axial direction Da so as to be parallel to the axis O1 of the casing 2.

Figure 3:
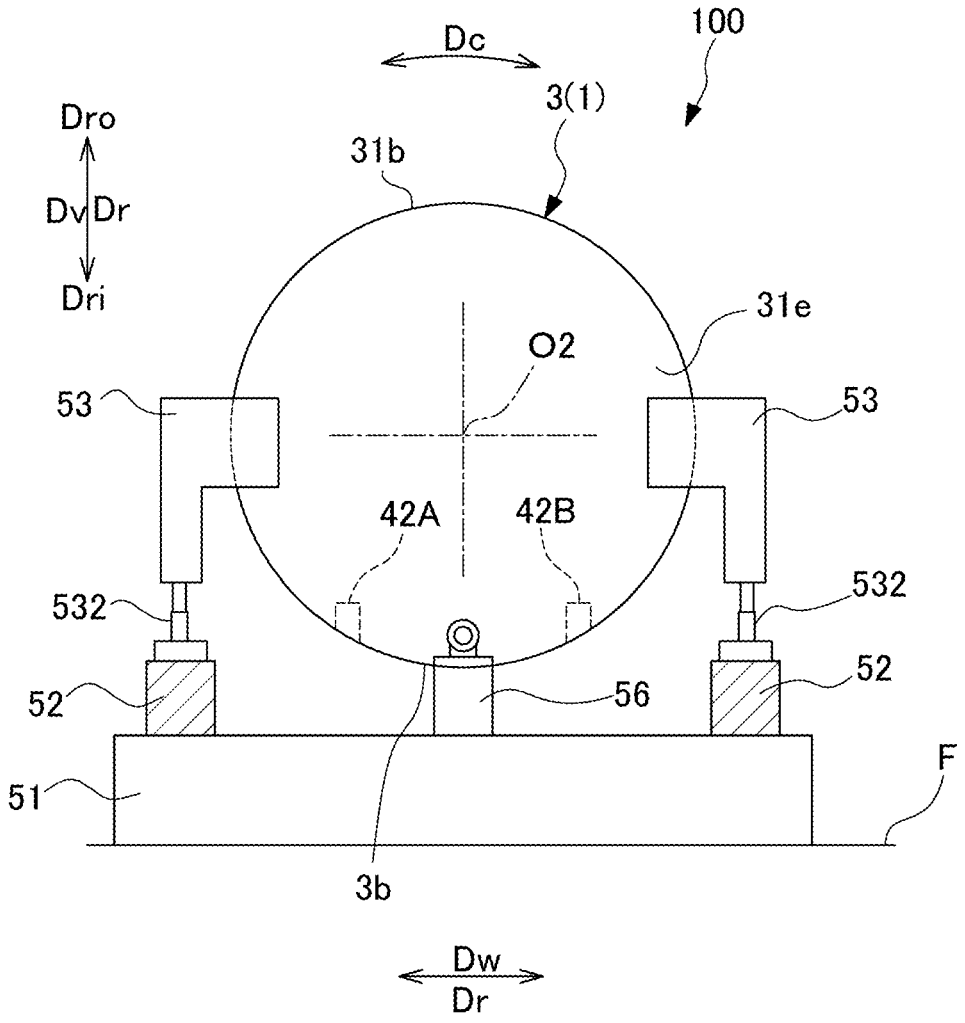
FIG. 3 is a sectional view taken along line A-A of FIG. 2 and as viewed in the direction of an arrow.

As shown in FIGS. 2 and 3, the first support member 53 can be mounted to an end surface 31*e* of the second end portion 31*b* on the second side Da2 of the bundle 3 in the axial direction Da. The first support member 53 supports the second end portion 31*b* on the second side Da2 of the bundle 3. The first support member 53 is detachably fixed to the end surface 31*e* orthogonal to the central axis O2 by bolts or the like. The first support member 53 is configured to be movable in the axial direction Da along the upper surface of the rail 52. The first support member 53 has a first height adjustment mechanism (height adjustment mechanism) 532 such as a hydraulic jack, which moves up and down the second end portion 31*b* of the bundle 3 in the vertical direction Dv. The first support member 53 adjusts the height in the vertical direction Dv of the second end portion 31*b* of the bundle 3 by operating the first height adjustment mechanism 532.

Figure 4:
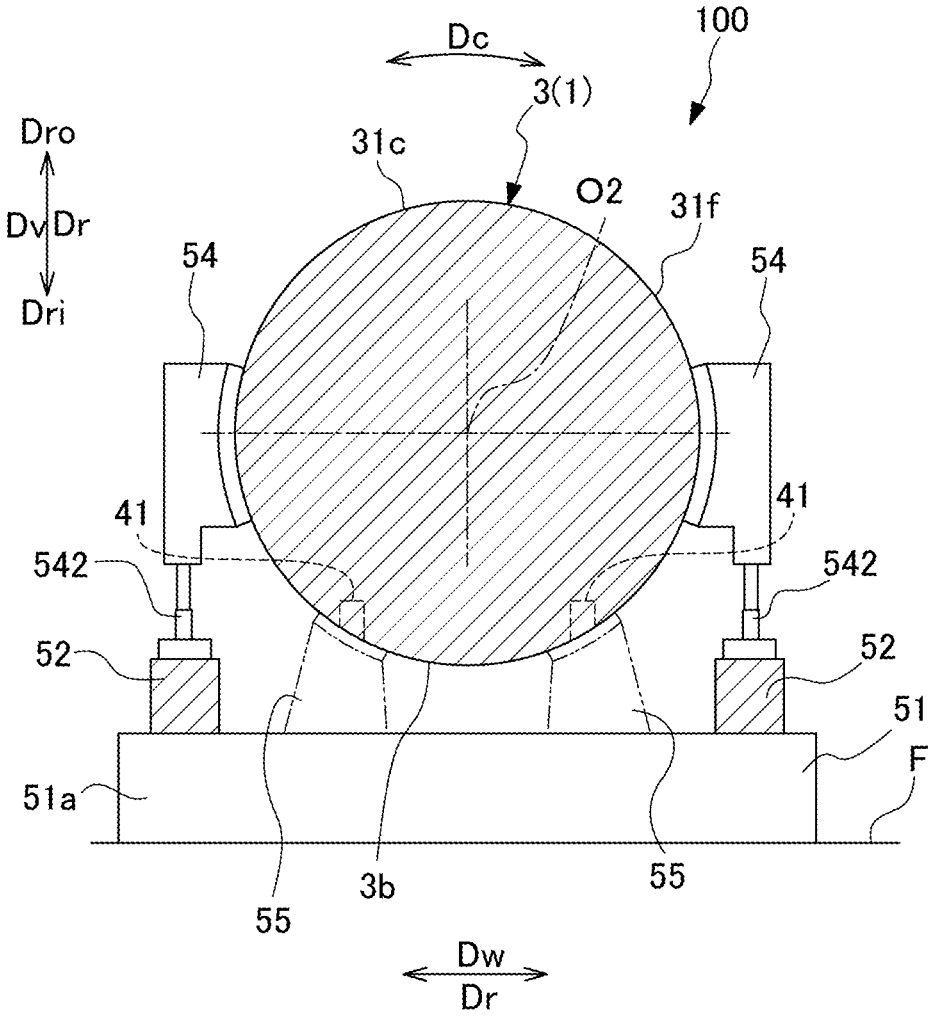
FIG. 4 is a sectional view taken along line B-B of FIG. 2 and as viewed in the direction of an arrow.

As shown in FIGS. 2 and 4, the second support members 54 are disposed on both sides of the bundle 3 in the width direction Dw. The second support member 54 supports the intermediate portion 31*c* of the bundle 3. Each of the second support members 54 is detachably fixed to an outer peripheral surface 31*f* of the bundle 3 at the intermediate portion 31*c* of the bundle 3 in the axial direction Da by bolts or the like. The second support member 54 is fixed to the outer peripheral surface 31*f* near the middle of the bundle 3 in the vertical direction Dv. The second support member 54 is configured to be movable in the axial direction Da along the upper surface of the rail 52. The second support member 54 has a second height adjustment mechanism (height adjustment mechanism) 542 such as a hydraulic jack, which moves up and down the intermediate portion 31*c* of the bundle 3 in the vertical direction Dv. The second support member 54 adjusts the height in the vertical direction Dv of the intermediate portion 31*c* of the bundle 3 by operating the second height adjustment mechanism 542.

The alignment member 55 is fixed onto the bundle stand 51. The alignment member 55 is disposed at a stand end portion 51*a*, which is an end portion on the first side Da1 of the bundle stand 51 in the axial direction Da. The alignment member 55 is disposed so as to be adjacent to the second side Da2 in the axial direction Da with respect to the casing 2. The alignment member 55 is disposed side by side with a casing second end portion 21*d*, which is the end portion on the second side Da2 of the casing 2 in the axial direction Da, so as to be continuous with the casing second end portion 21*d* in the axial direction Da. Two alignment members 55 are disposed in a pair at an interval in the width direction Dw between the pair of rails 52. The alignment members 55 are disposed at positions overlapping the first roller 41 and the second roller 42 in the circumferential direction Dc. The alignment member 55 extends upward from the bundle stand 51 and supports the bundle 3 from below. The position in the vertical direction Dv of the alignment member 55 can be adjusted. The bundle 3 is placed on the alignment members 55, whereby the position of the bundle 3 is adjusted through the alignment members 55 such that the central axis O2 of the bundle 3 is aligned with the axis O1 of the casing 2, before being inserted into the casing 2.

As shown in FIGS. 2 and 3, the movement mechanism 56 moves the bundle 3 in the axial direction Da with respect to the casing 2. The movement mechanism 56 includes, for example, a hydraulic jack. The movement mechanism 56 is disposed on the second side Da2 in the axial direction Da with respect to the bundle 3. The movement mechanism 56 moves the bundle 3 from the second side Da2 in the axial direction Da toward the first side Da1 by extending the hydraulic jack.

Figure 5:
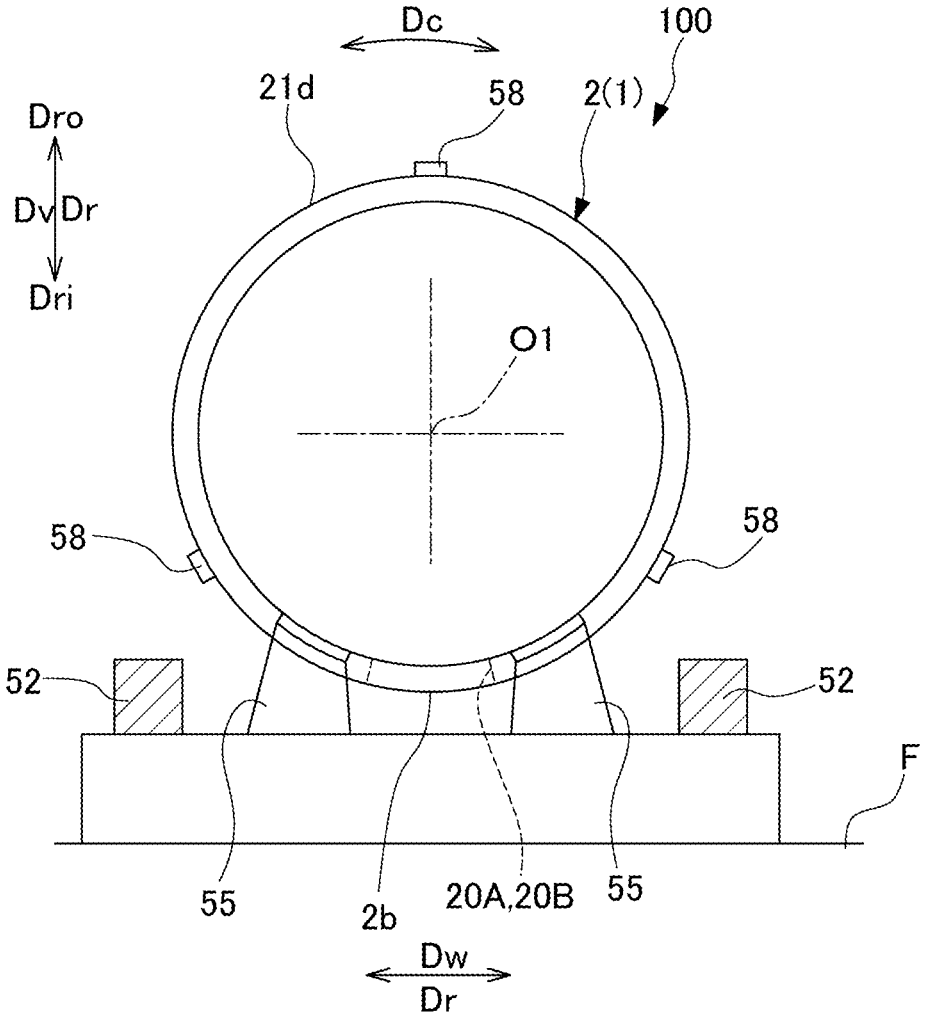
FIG. 5 is a sectional view taken along line C-C of FIG. 2 and as viewed in the direction of an arrow.

As shown in FIG. 2, the sensor 58 is detachably fixed to the casing second end portion 21*d*. The sensor 58 measures the interval between the outer peripheral surface of the bundle 3 and the inner peripheral surface 2*f* of the casing 2 in the radial direction Dr. That is, the sensor 58 monitors the gap in the radial direction Dr between the first end portion 31*a* of the bundle 3 and the casing second end portion 21*d* of the casing 2 before the bundle 3 is inserted into the casing 2. Further, the sensor 58 monitors the gap in the radial direction Dr between the outer peripheral surface of the bundle 3 and the inner peripheral surface 2*f* of the casing 2 while the bundle 3 is being inserted into the casing 2. As the sensor 58, for example, an optical sensor is used. As shown in FIG. 5, for example, three sensors 58 are disposed at intervals in the circumferential direction Dc. Two sets of sensors 58 may be provided at an interval in the axial direction Da.

(Procedure for Method of Assembling Compressor)

Figure 6:
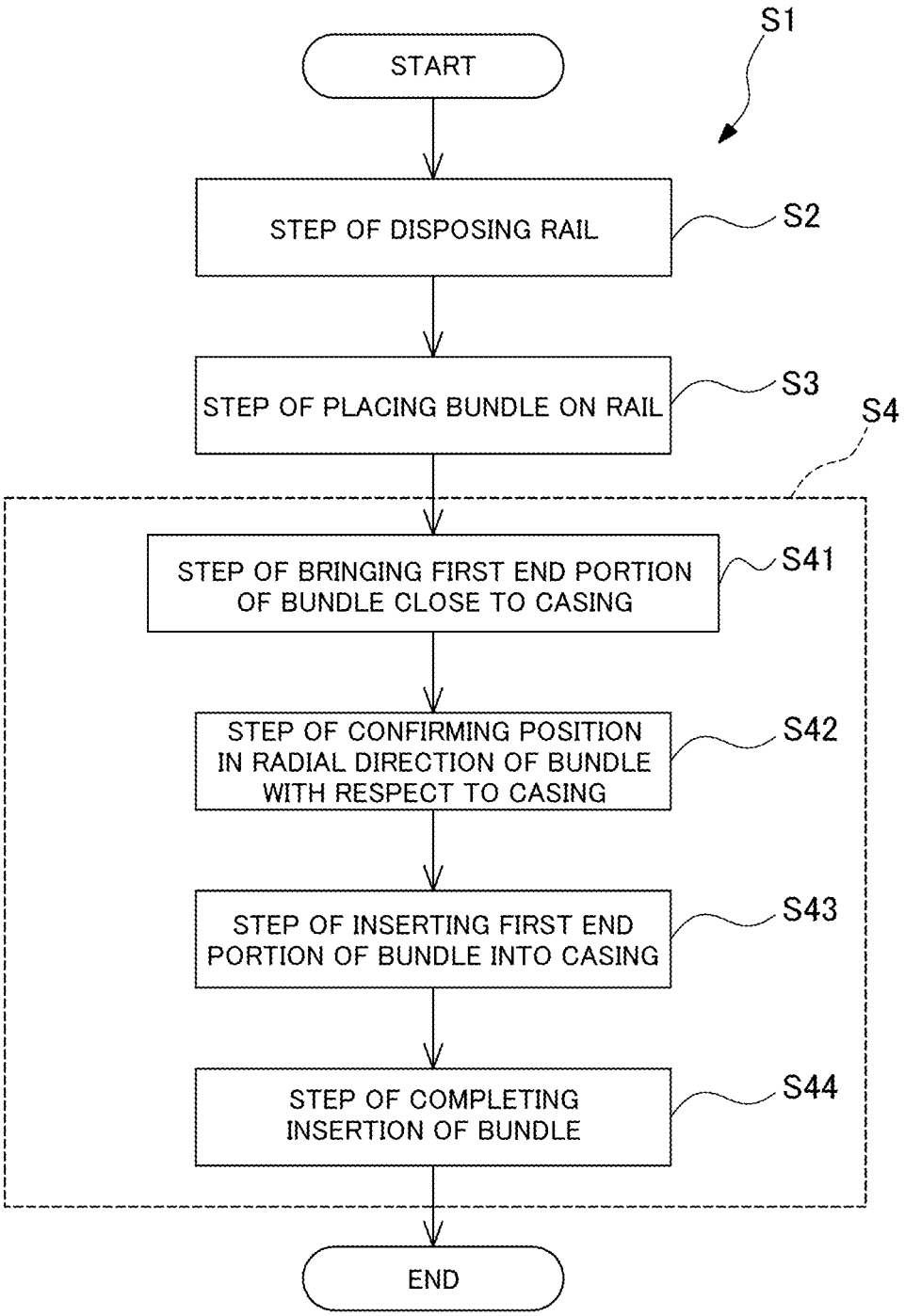
FIG. 6 is a flowchart showing a procedure for a method of assembling a compressor according to the embodiment of the present disclosure.

Next, a method of assembling the compressor 1 using the compressor insertion device 50 as described above will be described. As shown in FIG. 6, a method S1 of assembling the compressor 1 mainly includes a step S2 of disposing the rail 52, a step S3 of placing the bundle 3 on the rail 52, and a step S4 of inserting the bundle 3 into the casing 2.

Figure 7:
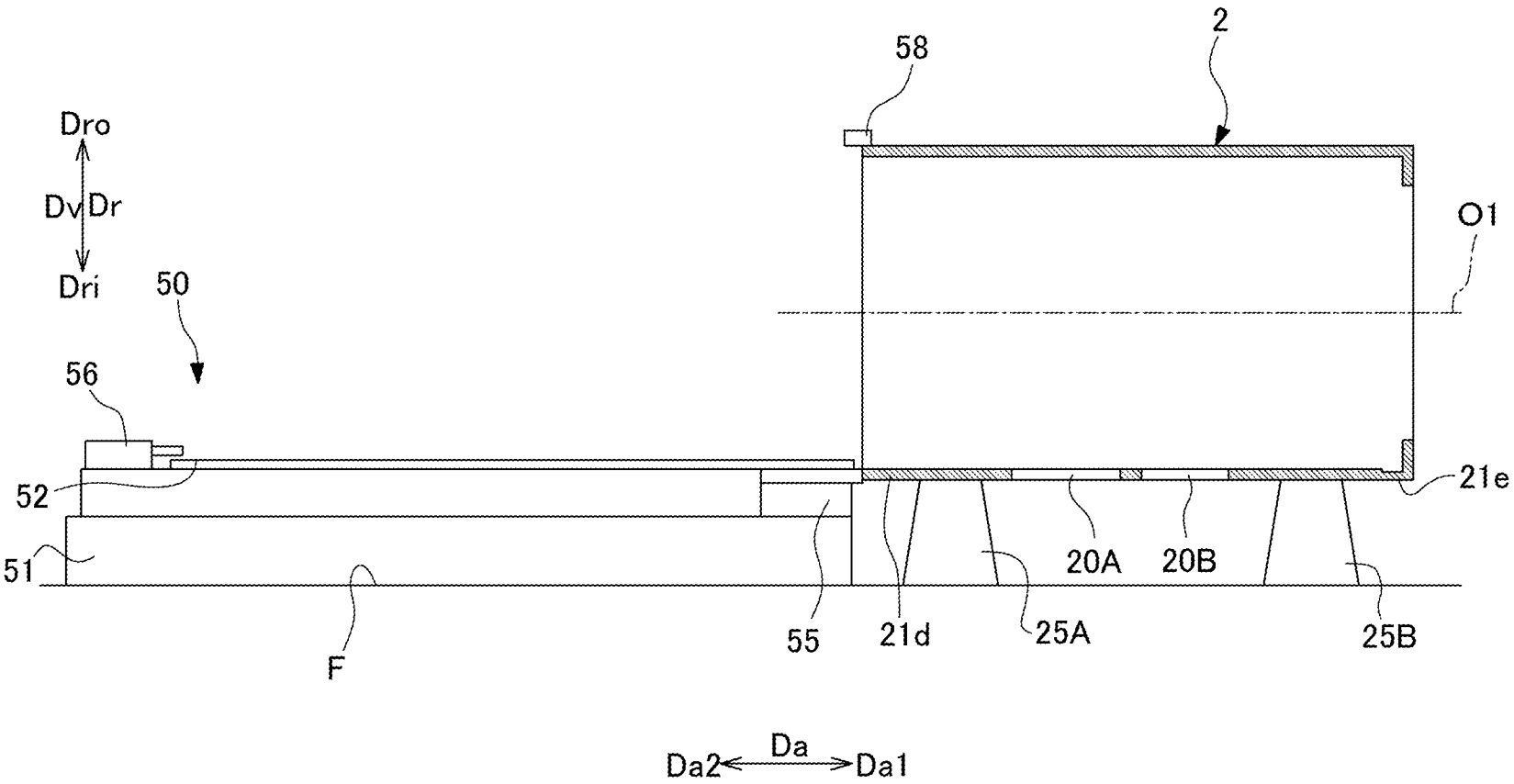
FIG. 7 is a side sectional view showing a step of disposing a rail in the method of assembling a compressor according to the embodiment of the present disclosure.

In the step S2 of disposing the rail 52, as shown in FIG. 7, the casing 2 is placed on the installation surface F. Thereafter, the bundle stand 51 with the rail 52 fixed thereto is disposed on the installation surface F on the second side Da2 in the axial direction Da with respect to the casing 2. At that time, the bundle stand 51 is disposed with respect to the casing 2 such that the rail 52 is parallel to the axis O1 of the casing 2. The alignment member 55 and the movement mechanism 56 are mounted to the bundle stand 51. Further, the sensor 58 is mounted to the casing second end portion 21*d*.

Figure 8:
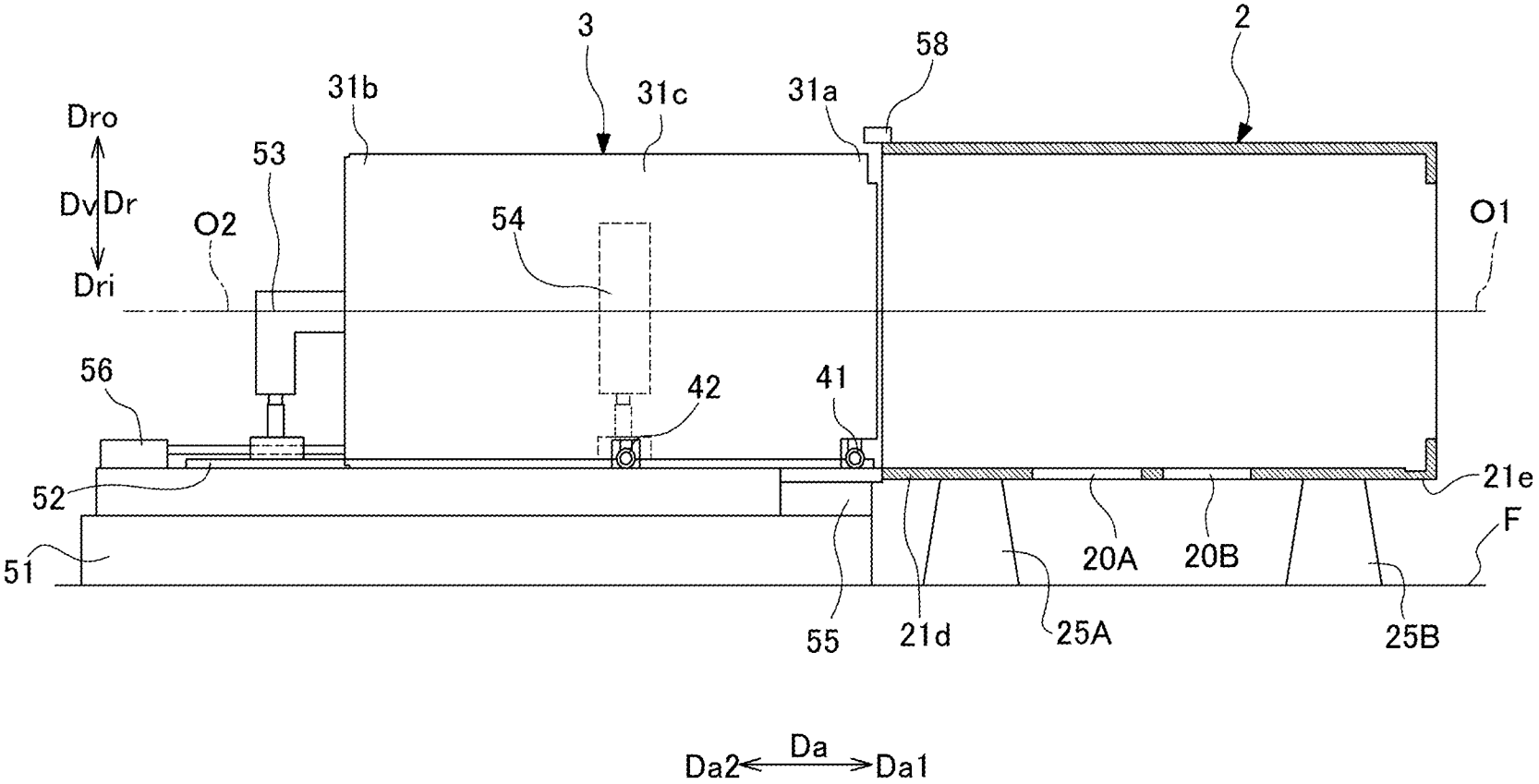
FIG. 8 is a side sectional view showing a step of placing a bundle on the rail in the method of assembling a compressor according to the embodiment of the present disclosure.

Next, in step S3, as shown in FIG. 8, the bundle 3 is placed on the rail 52 by using a lifting machine such as a crane. At this time, the bundle 3 is placed on the rail 52 such that the first roller 41 is disposed on the alignment member 55. Further, the first support member 53 is mounted to the second end portion 31*b* of the bundle 3. The pair of second support members 54 is mounted to the intermediate portion 31*c* in the axial direction Da of the bundle 3.

Subsequently, in the step S4 of inserting the bundle 3 into the casing 2, the bundle 3 is moved to the first side Da1 in the axial direction Da along the rail 52 and inserted into the casing 2. Specifically, in this step S4, first, the movement mechanism 56 is operated to move the first support member 53 and the second support member 54 to the first side Da1 in the axial direction Da along the rail 52 and bring the first end portion 31*a* of the bundle 3 close to the casing 2 (step S41).

Next, the position (interval) in the radial direction Dr of the bundle 3 with respect to the casing 2 is confirmed by the sensor 58 (step S42). At this time, in a case where a difference in the interval in the radial direction Dr of the bundle 3 with respect to the casing 2 is a level equal to or higher than a specified level between the plurality of sensors 58 disposed in the circumferential direction Dc, the height adjustment is performed on the second side Da2 in the axial direction Da of the bundle 3 by the first height adjustment mechanism 532 of the first support member 53 and the second height adjustment mechanism 542 of the second support member 54. In this way, the central axis O2 of the bundle 3 is aligned with the axis O1 of the casing 2.

Figure 9:
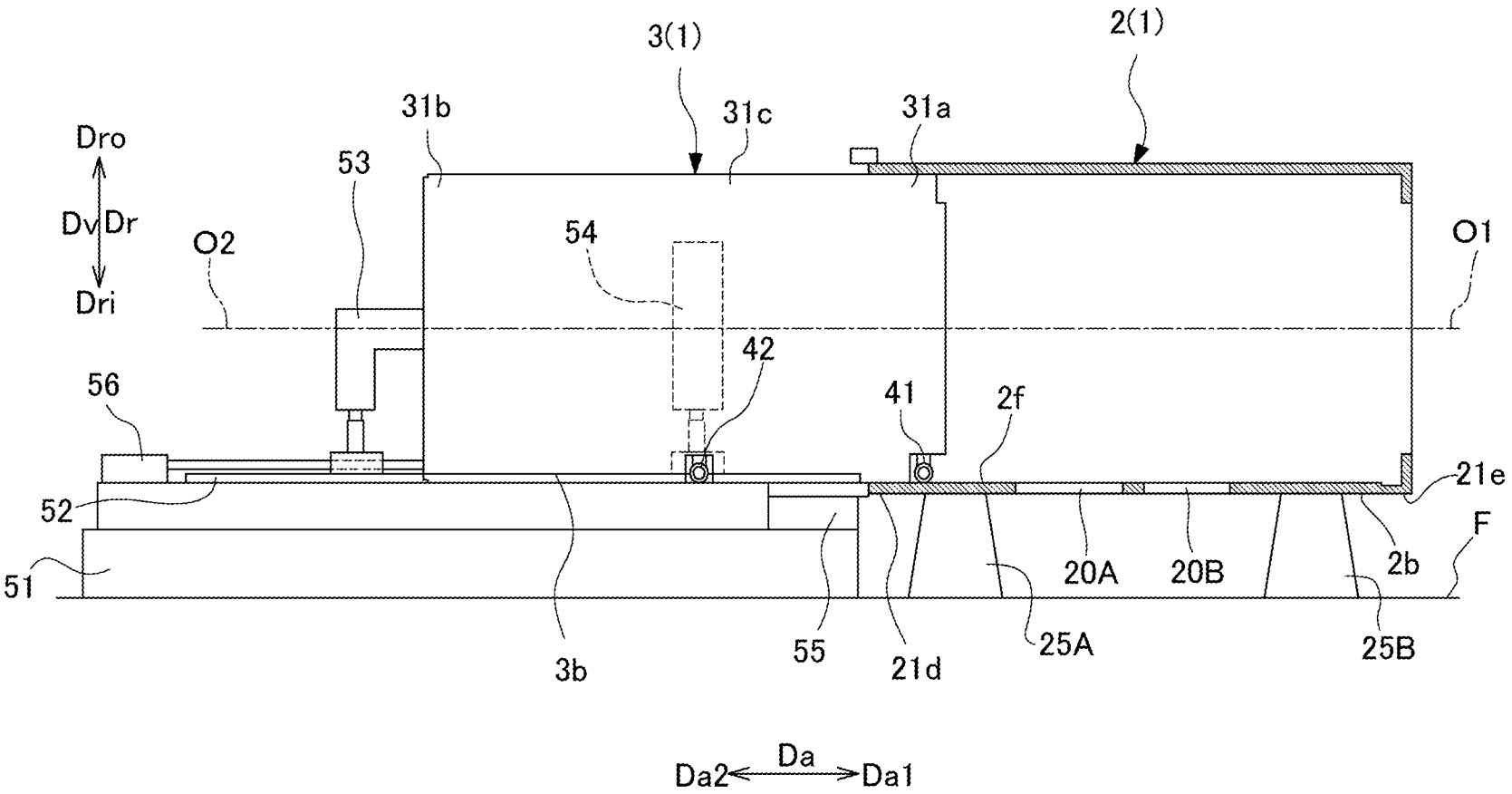
FIG. 9 is a side sectional view showing a step of inserting a first end portion of the bundle into a casing in the method of assembling a compressor according to the embodiment of the present disclosure.

Thereafter, as shown in FIG. 9, the bundle 3 is pushed toward the first side Da1 in the axial direction Da by the movement mechanism 56. In this way, the first support member 53 and the second support member 54 are moved to the first side Da1 in the axial direction Da along the rail 52, and the first end portion 31*a* of the bundle 3 with the first support member 53 and the second support member 54 fixed thereto is inserted into the casing 2 (step S43). When the first end portion 31*a* of the bundle 3 is inserted into the casing 2, first, only the first roller 41 fixed to the first end portion 31*a* of the bundle 3 comes into contact with the inner peripheral surface 2*f* of the lower portion 2*b* of the casing 2. In this way, the load of the bundle 3 is supported by the first roller 41, the first support member 53, and the second support member 54.

Figure 10:
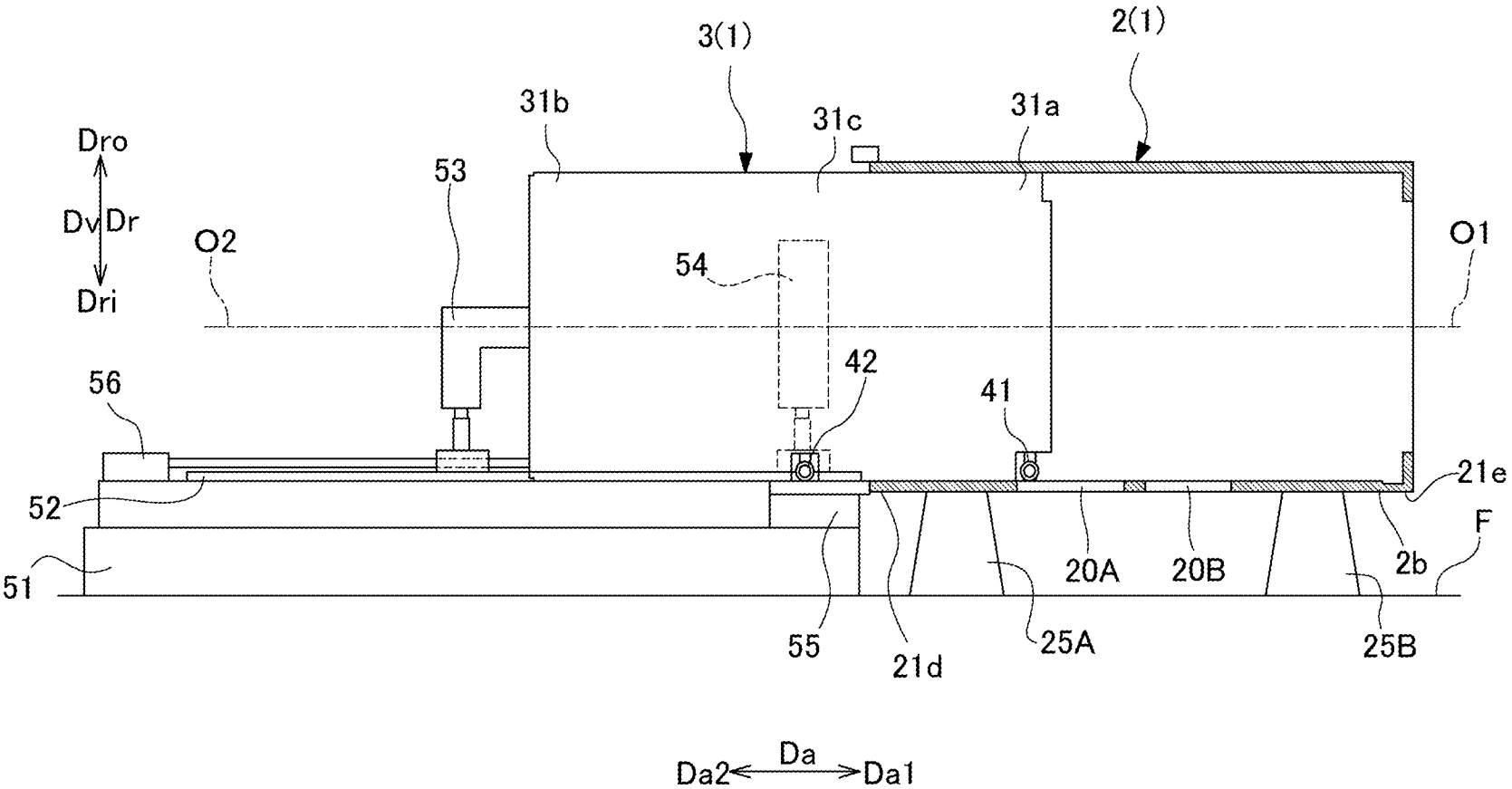
FIG. 10 is a side sectional view showing a state where a first roller overlaps a first opening portion in an axial direction and a load of the bundle is supported by a second roller that is located on an alignment member.

As shown in FIG. 10, when the bundle 3 is further moved to the first side Da1 in the axial direction, the second roller 42 reaches above the alignment member 55. In this state, the second support member 54 is removed from the bundle 3. Thereafter, when the bundle 3 is further moved to the first side Da1 in the axial direction, the first roller 41 approaches a position overlapping the first opening portion 20A in the axial direction Da. In this state, the first roller 41 is in a state of floating with respect to the casing 2 (a state of being in non-contact with the casing 2), and the load of the bundle 3 is supported by the second roller 42 and the first support member 53.

Figure 11:
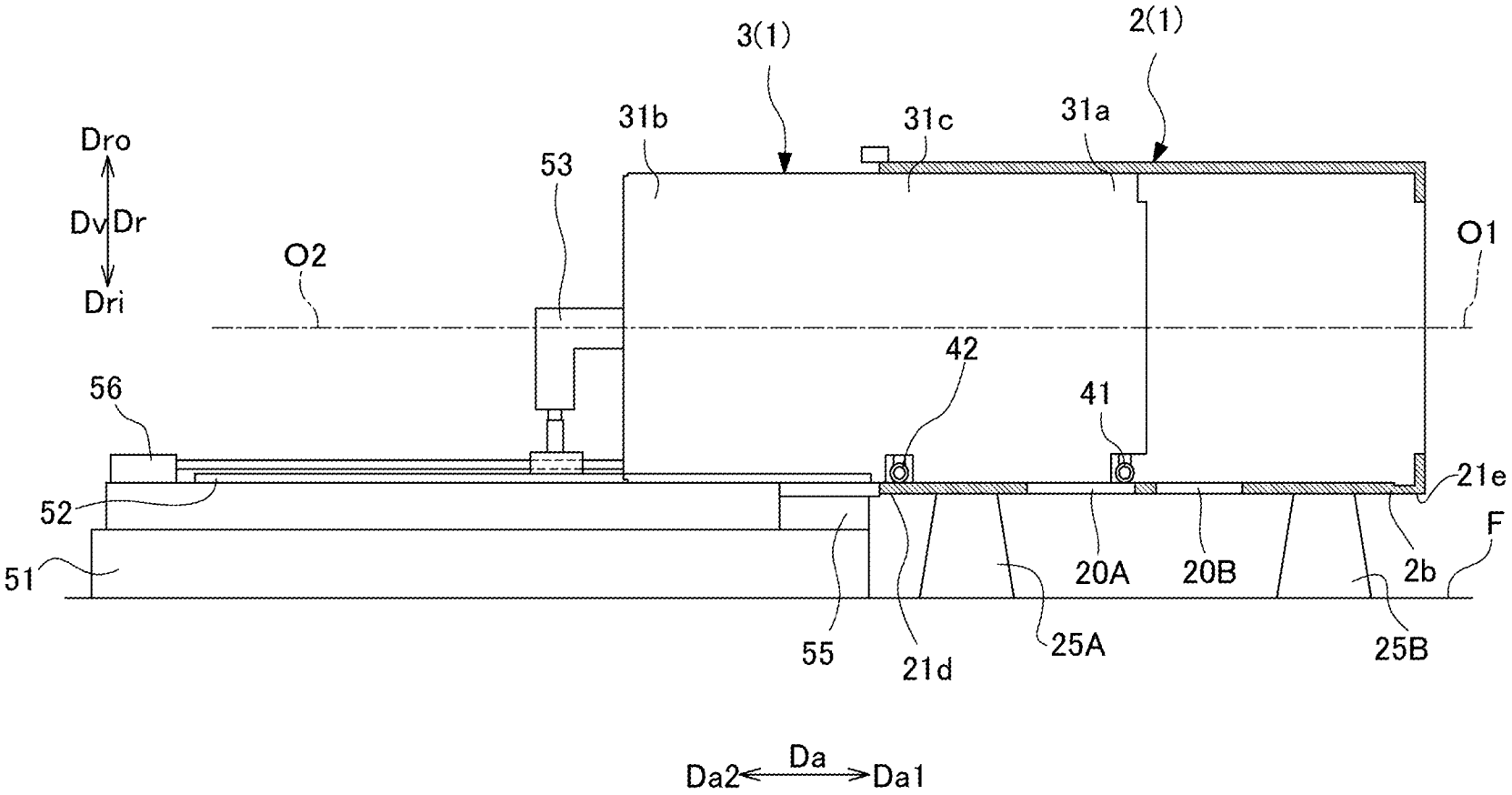
FIG. 11 is a side sectional view showing a state where the first roller overlaps the first opening portion in the axial direction and the load of the bundle is supported by the second roller that is located in the casing.

As shown in FIG. 11, when the bundle 3 is further moved to the first side Da1 in the axial direction, the second roller 42 is transferred from the alignment member 55 onto the inner peripheral surface 2*f* of the casing 2 and continues to support the load of the bundle 3.

Figure 12:
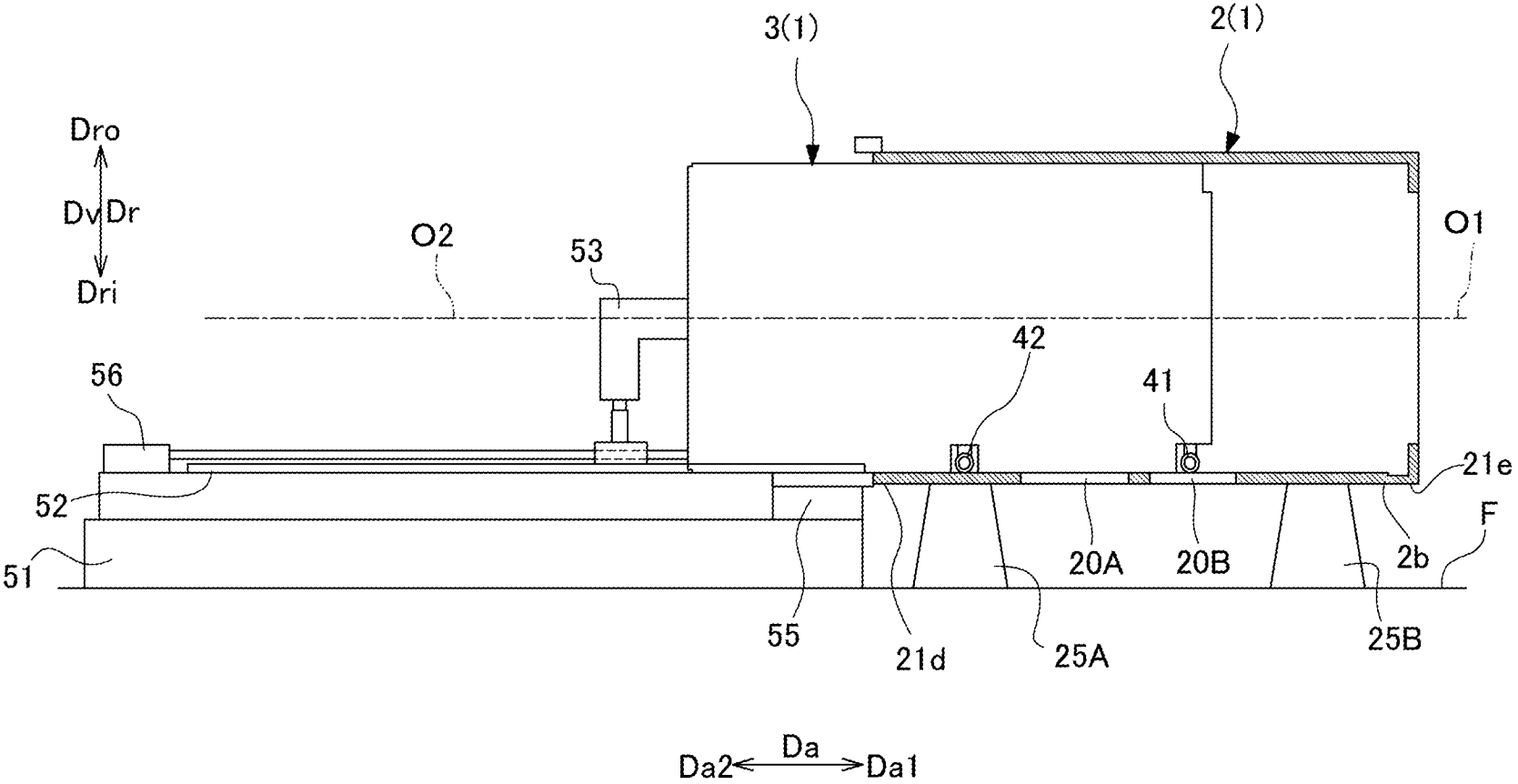
FIG. 12 is a side sectional view showing a state where the first roller overlaps a second opening portion in the axial direction and the load of the bundle is supported by the second roller.

As shown in FIG. 12, when the bundle 3 is further moved to the first side Da1 in the axial direction, the first roller 41 reaches a position overlapping the second opening portion 20B in the axial direction Da. Even in this state, the second roller 42 comes into contact with the inner peripheral surface 2*f* of the lower portion 2*b* of the casing 2 and supports the load of the bundle 3.

Figure 13:
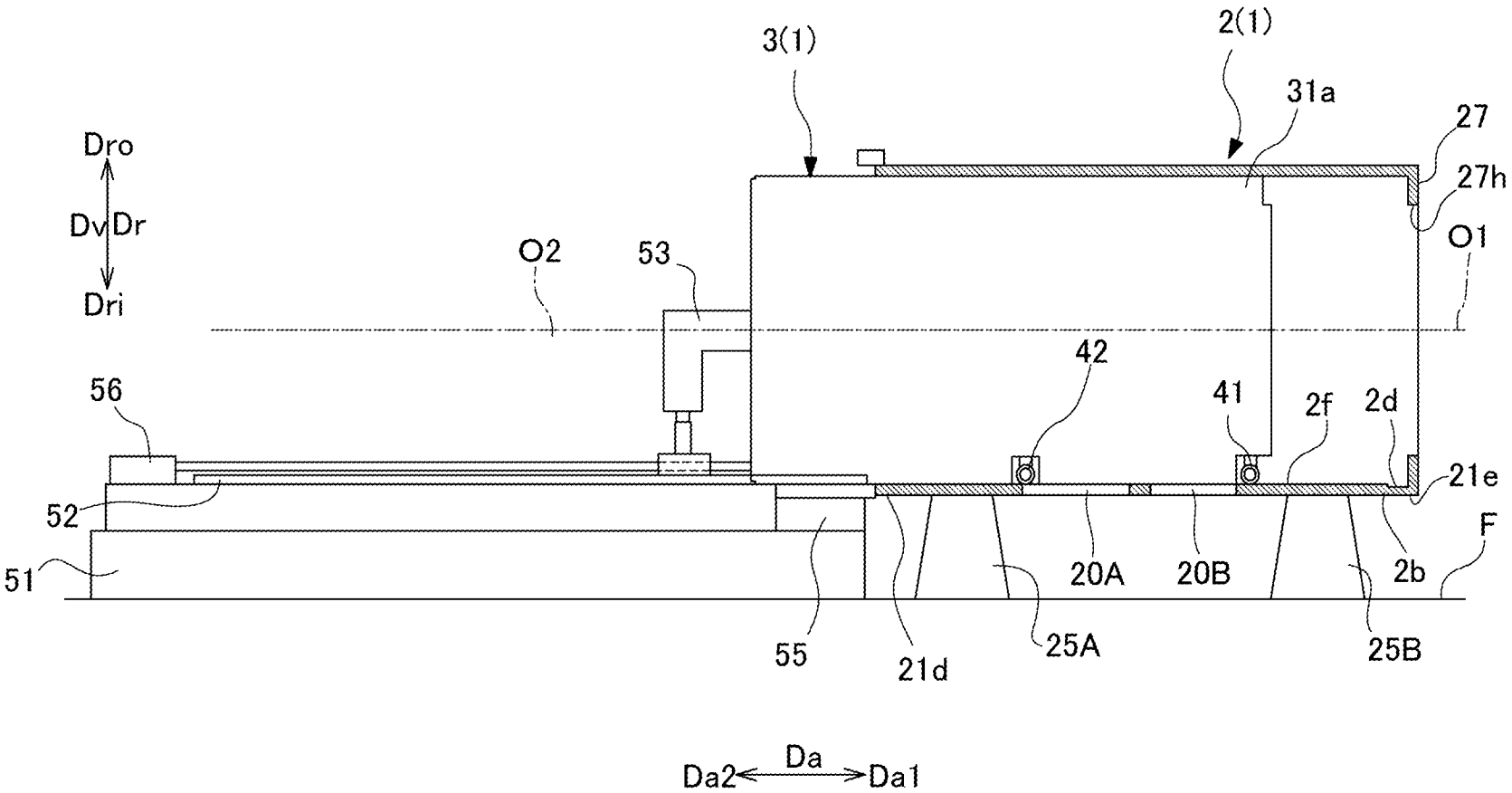
FIG. 13 is a side sectional view showing a state where the second roller overlaps the first opening portion in the axial direction and the load of the bundle is supported by the first roller.

As shown in FIG. 13, when the bundle 3 is further moved to the first side Da1 in the axial direction, the second roller 42 reaches a position overlapping the first opening portion 20A in the axial direction Da. In this state, the first roller 41 reaches the first side Da1 in the axial direction Da with respect to the second opening portion 20B. In this way, the first roller 41 comes into contact with the inner peripheral surface 2*f* of the lower portion 2*b* of the casing 2 and supports the load of the bundle 3.

Figure 14:
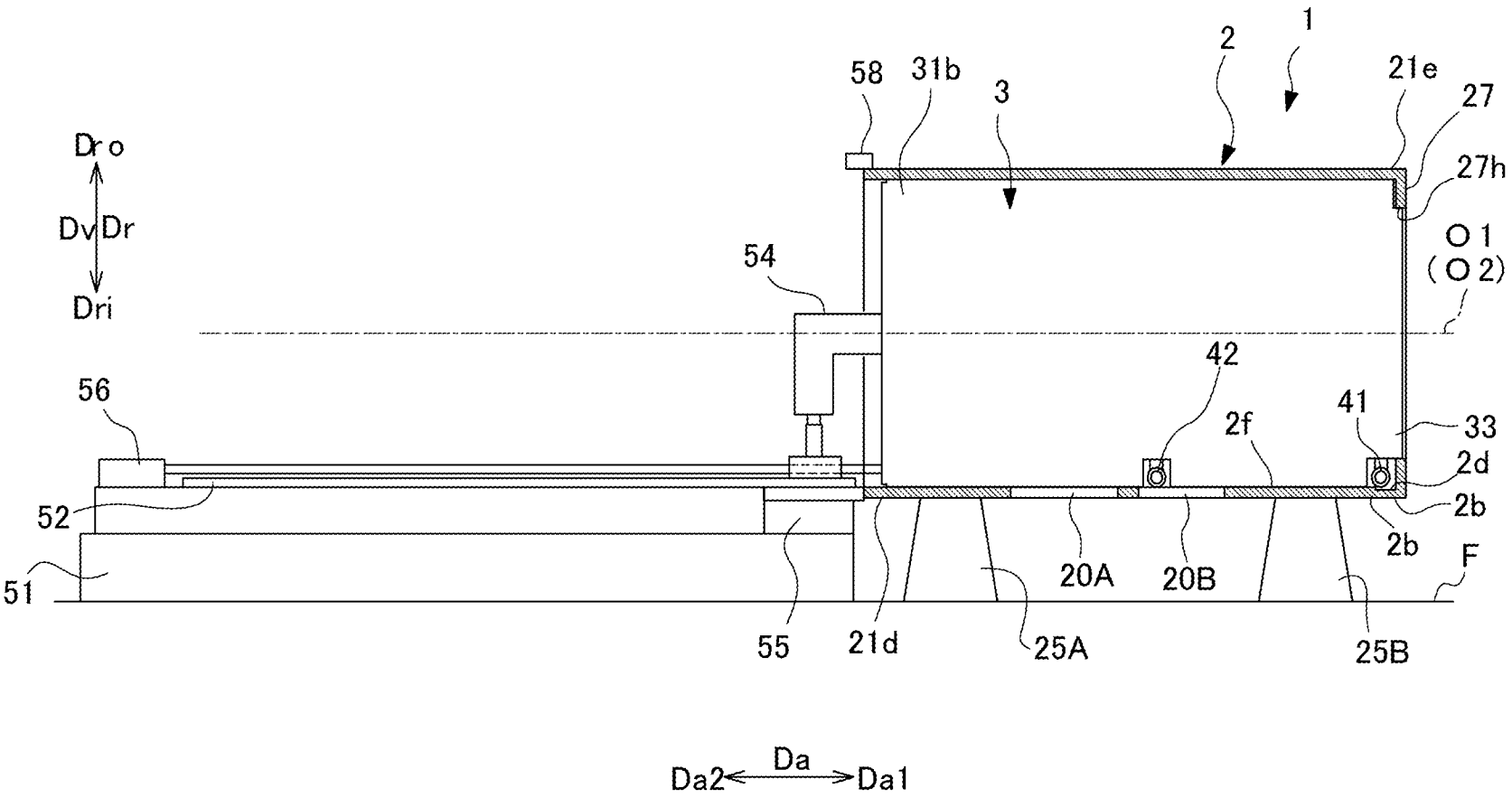
FIG. 14 is a side sectional view showing a state where the insertion of the bundle into the casing is completed.

Thereafter, as shown in FIG. 14, when the first end portion 31*a* of the bundle 3 reaches a casing first end portion 21*e* of the casing 2, a leading end boss portion 33 protruding to the first side Da1 in the axial direction Da in the first end portion 31*a* of the bundle 3 is inserted into the insertion hole 27*h* on the inside Dri in the radial direction at the casing first end portion 21*e* of the casing 2 and placed on the end plate 27. At this time, the first roller 41 is put in a recessed portion 2*d* which is formed on the inner peripheral surface 2*f* of the casing 2 and slightly recessed toward the outside Dro in the radial direction Dr.

Further, the second end portion 31*b* of the bundle 3 and the casing second end portion 21*d* of the casing 2 are connected by a metal fitting (not shown) or the like. Thereafter, the first support member 53 is removed from the bundle 3. Further, the bundle stand 51, the alignment member 55, the sensor 58, and the like are removed. In this way, the insertion of the bundle 3 into the casing 2 is completed (step S44). In a case where the bundle 3 is pulled out and removed from the casing 2, the above procedure may be performed in the reverse order.

(Operation and Effect)

In the compressor 1 having the configuration described above, the first roller 41 and the second roller 42 are fixed to the bundle 3 at an interval in the axial direction Da. Therefore, in a case where the bundle 3 is inserted into the casing 2, even if any one of the first roller 41 and the second roller 42 overlaps the first opening portion 20A or the second opening portion 20B in the axial direction Da, the other of the first roller 41 and the second roller 42 comes into contact with the inner peripheral surface 2*f* of the casing 2 to support the bundle 3. That is, a state where the bundle 3 is supported with respect to the casing 2 by the first roller 41 and the second roller 42 can be maintained for a long period of time. Therefore, it is possible to prevent the bundle 3 from being tilted with respect to the casing 2 due to being fitted when the first roller 41 or the second roller 42 passes over the first opening portion 20A or the second opening portion 20B. In this way, even in the casing 2 in which the opening portion is formed in the lower portion in the vertical direction Dv, it is possible to easily and reliably perform the insertion of the bundle 3.

Further, the interval S between the first roller 41 and the second roller 42 in the axial direction Da is larger than the opening dimension in the axial direction Da of the first opening portion 20A or the second opening portion 20B. In particular, in the present embodiment, the interval S is larger than the opening dimension K between the first opening edge 21*s* on the second side Da2 of the first opening portion 20A in the axial direction Da and the second opening edge 22*s* on the first side Da1 of the second opening portion 20B in the axial direction Da. Therefore, both the first roller 41 and the second roller 42 do not simultaneously overlap the first opening portion 20A or the second opening portion 20B in the axial direction Da. Therefore, a state where the bundle 3 is supported with respect to the casing 2 by one of the first roller 41 and the second roller 42 can be always maintained. In this way, even in the casing 2 in which the opening portion is formed in the lower portion in the vertical direction Dv, it is possible to easily and reliably perform the insertion of the bundle 3.

Further, the second roller 42 is disposed at the intermediate portion 31*c* of the bundle 3 in the axial direction Da. When the first roller 41 disposed at the first end portion 31*a*, which is a leading end of the bundle 3, overlaps the first opening portion 20A or the second opening portion 20B, the bundle 3 can be supported by the second roller 42 at a position in the middle in the axial direction Da. Therefore, it is possible to prevent the bundle 3 from tilting such that the first end portion 31*a* or the second end portion 31*b* is greatly sunk.

Further, the first roller 41 and the second rollers 42 are disposed two by two at an interval in the circumferential direction Dc. In this way, the bundle 3 can be supported in a stable posture with respect to the casing 2.

Further, the height of the bundle 3 can be finely adjusted by the first support member 53 having the first height adjustment mechanism 532 or the second support member 54 having the second height adjustment mechanism 542, before it is inserted into the casing 2. In this way, in the process of inserting the bundle 3 into the casing 2, the bundle 3 protruding from the casing 2 toward the second side Da2 in the axial direction Da can be moved along the rail 52 while it is finely adjusted by the first support member 53 and the second support member 54.

Further, the bundle 3 in a state of being positioned in front of the casing 2 by the alignment member 55 can be inserted into the casing 2.

Further, when the bundle 3 is inserted into the casing 2, the sensor 58 is fixed to the casing 2. The alignment of the bundle 3 with respect to the casing 2 when inserting the bundle 3 can be stably performed by the sensor 58 that measures the interval between the outer peripheral surface of the bundle 3 and the inner peripheral surface 2*f* of the casing 2 in the radial direction Dr.

OTHER EMBODIMENTS

The embodiment of the present disclosure has been described in detail above with reference to the drawings. However, the specific configuration is not limited to the embodiment, and also includes design changes and the like within a scope that does not deviate from the gist of the present disclosure.

In the present embodiment, the first roller 41 and the second roller 42 are disposed two by two. However, there is no limitation to such a configuration. Only one first roller 41 and only one the second roller 42 may be disposed at the lowermost end of the bundle 3 in the vertical direction Dv. Further, three or more first rollers 41 and three or more second rollers 42 may be disposed at intervals in the circumferential direction Dc.

Further, in the present embodiment, an optical sensor is used as the sensor 58. However, there is no limitation of the sensor to such a configuration. As long as the sensor 58 can be detected the positional deviation in the radial direction Dr of the bundle 3 with respect to the casing 2, for example, a load sensor or the like, which detects the load of the bundle 3, may be used as the sensor 58.

ADDITIONAL REMARK

The compressor 1, the compressor assembly 100, and the method of assembling the compressor 1 according to the embodiment are grasped as follows, for example.

(1) The compressor 1 according to a first aspect includes: the casing 2 that is formed in a cylindrical shape centered on the axis O1 and has the opening portion 20A that makes the inside and the outside communicate with each other at the lower portion 2*b* in the vertical direction Dv; the bundle 3 that is formed in a columnar shape extending in the axial direction Da in which the axis O1 extends, and accommodated inside the casing 2 in the radial direction Dr with respect to the axis O1 in a state of being able to be inserted and removed in the axial direction Da with respect to the casing 2; the first roller 41 that is disposed at an end portion of a lower portion of the bundle 3 in the vertical direction Dv and comes into contact with the inner peripheral surface 2*f* of the lower portion 2*b* of the casing 2 in a state where the bundle 3 is inserted into the casing 2; and the second roller 42 that is disposed at the lower portion of the bundle 3 in the vertical direction Dv at an interval from the first roller 41 in the axial direction Da, and comes into contact with the inner peripheral surface 2*f* of the lower portion 2*b* of the casing 2 in a state where the bundle 3 is inserted in the casing 2.

In the compressor 1, the first roller 41 and the second roller 42 are disposed at the bundle 3 at an interval in the axial direction Da. Therefore, in a case where the bundle 3 is inserted into the casing 2, even if any one of the first roller 41 and the second roller 42 overlaps the opening portion 20A in the axial direction Da, the other of the first roller 41 and the second roller 42 comes into contact with the inner peripheral surface 2*f* of the casing 2 to support the bundle 3. That is, a state where the bundle 3 is supported with respect to the casing 2 by the first roller 41 and the second roller 42 can be maintained for a long period of time. Therefore, it is possible to prevent the bundle 3 from being tilted with respect to the casing 2 due to being fitted when the first roller 41 or the second roller 42 passes over the opening portion 20A. In this way, even in the casing 2 in which the opening portion is formed in the lower portion in the vertical direction Dv, it is possible to easily and reliably perform the insertion of the bundle 3.

(2) In the compressor 1 according to a second aspect, in the compressor 1 of the above (1), the interval S between the first roller 41 and the second roller 42 in the axial direction Da is larger than the opening dimension K in the axial direction Da of the opening portions 20A and 20B.

In this way, both the first roller 41 and the second roller 42 do not simultaneously overlap the opening portion 20A in the axial direction Da. Therefore, a state where the bundle 3 is supported with respect to the casing 2 by one of the first roller 41 and the second roller 42 can be always maintained. In this way, even in the casing 2 in which the opening portion is formed in the lower portion in the vertical direction Dv, it is possible to easily and reliably perform the insertion of the bundle 3.

(3) In the compressor 1 according to a third aspect, in the compressor 1 of the above (1) or (2), the second roller 42 is disposed at the intermediate portion 31*c* between the end portion 31*a* on the first side Da1 of the bundle 3 in the axial direction Da and the end portion 31*b* on the second side Da2 in the axial direction Da.

In this way, when the first roller 41 overlaps the opening portion 20A, the bundle 3 can be supported by the second roller 42 at a position in the middle in the axial direction Da. Therefore, it is possible to prevent the bundle 3 from tilting such that the end portion of the bundle 3 is greatly sunk.

(4) In the compressor 1 according to a fourth aspect, in the compressor 1 of any one of the above (1) to (3), a plurality of the first rollers 41 and a plurality of the second rollers 42 are disposed at intervals in the circumferential direction Dc around the central axis O2 of the bundle 3.

In this way, the bundle 3 can be supported in a stable posture with respect to the casing 2.

(5) The compressor assembly 100 according to a fifth aspect includes: the compressor 1 according to any one of the above (1) to (4); and the sensor 58 that is disposed at an end portion of the casing 2 in the axial direction Da and measures an interval between the outer peripheral surface of the bundle 3 and the inner peripheral surface 2*f* of the casing 2 in the radial direction Dr.

In this way, the alignment of the bundle 3 with respect to the casing 2 when inserting the bundle 3 can be stably performed by the sensor 58.

(6) The method of assembling the compressor 1 according to a sixth aspect is a method of assembling the compressor 1 according to any one of the above (1) to (4), and includes: bringing the other of the first roller 41 and the second roller 42 into contact with the inner peripheral surface 2*f* of the lower portion of the casing 2 in a case where one of the first roller 41 and the second roller 42 is at a position overlapping the opening portion in the axial direction Da, when the bundle 3 is inserted into the casing 2.

In this way, it is possible to prevent the bundle 3 from being tilted with respect to the casing 2 due to being fitted when the first roller 41 or the second roller 42 passes over the opening portion 20A. In this way, even in the casing 2 in which the opening portion is formed in the lower portion in the vertical direction Dv, it is possible to easily and reliably perform the insertion of the bundle 3.

EXPLANATION OF REFERENCES

1: compressor
1A: compressor main body
2: casing
2*b*: lower portion
2*d*: recessed portion
2*f*: inner peripheral surface
3: bundle
3*b*: lower portion
20A: first opening portion (opening portion)
20B: second opening portion (opening portion)
21*d*: casing second end portion
21*e*: casing first end portion
21*s*: first opening edge
22*s*: second opening edge
25A: first support leg
25B: second support leg
27: end plate
27*h*: insertion hole
31*a*: first end portion (end portion)
31*b*: second end portion (end portion)
31*c*: intermediate portion
31*e*: end surface
31*f*: outer peripheral surface
33: leading end boss portion
41: first roller
42: second roller
50: compressor insertion device
51: bundle stand
51*a*: stand end portion
52: rail
53: first support member
54: second support member
55: alignment member
56: movement mechanism
58: sensor
532: first height adjustment mechanism (height adjustment mechanism)
542: second height adjustment mechanism (height adjustment mechanism)
100: compressor assembly
Da: axial direction
Da1: first side
Da2: second side
Dc: circumferential direction
Dr: radial direction
Dri: inside
Dro: outside
Dv: vertical direction
Dw: width direction
F: installation surface
K: opening dimension
O1: axis
O2: central axis
P1: first compression unit
P2: second compression unit
S1: method of assembling compressor
S2: step of disposing rail
S3: step of placing bundle on rail
S4: step of inserting bundle into casing
S41: step of bringing first end portion of bundle close to casing
S42: step of confirming position in radial direction of bundle with respect to casing
S43: step of inserting first end portion of bundle into casing
S44: step of completing bundle insertion

What is claimed is:

1. A compressor comprising:

a casing that has a cylindrical shape centered on an axis and has a first opening portion and a second opening portion that penetrate the casing between an inside and an outside of the casing in a vertical direction such that the inside and the outside of the casing communicate with each other at a lower portion of the casing in the vertical direction, wherein the first opening portion communicates with a first nozzle forming an inflow port or an outflow port for working fluid, the second opening portion communicates with a second nozzle forming an inflow port or an outflow port for the working fluid, and the second opening portion is formed at a position separated from the first opening portion in an axial direction in which the axis extends;

a bundle that is formed in a columnar shape extending in the axial direction, and accommodated inside the casing in a radial direction with respect to the axis in a state of being insertable and removable in the axial direction with respect to the casing;

a first roller that is disposed at an end portion of a lower portion of the bundle in the vertical direction and is disposed so as to come into contact with an inner peripheral surface of a lower portion of the casing in a state where the bundle is inserted into the casing; and a second roller that is disposed at the lower portion of the bundle in the vertical direction at an interval from the first roller in the axial direction, and is disposed so as to come into contact with the inner peripheral surface of the lower portion of the casing in a state where the bundle is inserted into the casing, wherein the first roller and the second roller do not simultaneously overlap the first opening portion and the second opening portion in the axial direction, the bundle remains supported with respect to the casing by one or both of the first roller and the second roller in a state where the bundle is inserted into the casing, and the interval is larger than a distance in the axial direction between an opening edge of the first opening portion that is farthest from the second opening portion in the axial direction and an opening edge of the second opening portion that is farthest from the first opening portion in the axial direction.

2. The compressor according to claim 1, wherein the second roller is disposed at an intermediate portion between an end portion on a first side and an end portion on a second side of the bundle in the axial direction.

3. The compressor according to claim 1, wherein a plurality of the first rollers and a plurality of the second rollers are disposed at intervals in a circumferential direction around a central axis of the bundle.

4. A compressor assembly comprising:

a compressor according to claim 1; and a sensor that is disposed at an end portion of the casing in the axial direction and measures an interval between an outer peripheral surface of the bundle and an inner peripheral surface of the casing in the radial direction.

5. A method of assembling the compressor according to claim 1, comprising:

bringing one of the first roller and the second roller into contact with the inner peripheral surface of the lower portion of the casing in a case where the other of the first roller and the second roller is at a position overlapping the first opening portion and the second opening portion in the axial direction, when the bundle is inserted into the casing.

* * * * *